US007368692B1

(12) United States Patent
Hallac

(10) Patent No.: US 7,368,692 B1
(45) Date of Patent: May 6, 2008

(54) RIDGED SERPENTINE WAVEGUIDE APPLICATOR

(75) Inventor: Abdulkadir Hallac, Morrisville, NC (US)

(73) Assignee: Industrial Microwave Systems, L.L.C., Morrisville, NC (US)

( * ) Notice: Subject to any disclaimer, the term of this patent is extended or adjusted under 35 U.S.C. 154(b) by 0 days.

(21) Appl. No.: 11/627,422

(22) Filed: Jan. 26, 2007

(51) Int. Cl.
*H05B 6/78* (2006.01)

(52) U.S. Cl. ..... 219/692; 219/693; 219/745; 333/239

(58) Field of Classification Search ..... 219/690–701, 219/745–746, 756; 333/239, 249
See application file for complete search history.

(56) References Cited

U.S. PATENT DOCUMENTS 3,475,577 A * 10/1969 Rische et al. ..... 219/692
3,555,232 A 1/1971 Bleackley
3,564,458 A 2/1971 Cumming
3,632,945 A 1/1972 Johnson
4,234,775 A 11/1980 Wolfberg et al.
4,246,462 A * 1/1981 Meisel ..... 219/700
4,259,561 A * 3/1981 Roussy et al. ..... 219/693
5,536,921 A 7/1996 Hedrick et al.
6,075,232 A 6/2000 Joines et al.
6,259,077 B1 7/2001 Drozd et al.
6,590,191 B2 7/2003 Drozd et al.
6,753,516 B1 6/2004 Butler et al.

OTHER PUBLICATIONS

Metaxas, A.C., and Meredith, R.J., "Industrial Microwave Heating," (Peter Peregrinus Ltd. on behalf of IEEE, London 1993), first published 1983, pp. 114-119.

* cited by examiner

*Primary Examiner*—Philip H. Leung
(74) *Attorney, Agent, or Firm*—James T. Cronvich

(57) ABSTRACT

A serpentine waveguide applicator for exposing a material to microwave energy for hearing, drying, or curing. A conveyor transports the material through aligned slots formed in facing sides at consecutive waveguide passes of the serpentine array. Each pass has a ridged waveguide structure with ridges in each corner of the otherwise rectangular waveguide. The ridges make the interior cross section of the waveguide passes cruciform and direct microwave energy away from the slots to reduce arcing, crosstalk, and leakage.

13 Claims, 2 Drawing Sheets

RIDGED SERPENTINE WAVEGUIDE APPLICATOR

BACKGROUND

The invention relates generally to microwave heating, drying, and curing and, more particularly, to ridged serpentine waveguide applicators for heating, drying, or curing conveyed materials.

Serpentine applicators, in which slotted waveguides are arranged side by side and connected in series so that microwave energy flows in opposite directions in consecutive waveguides, are used to heat, dry, or cure materials conveyed through slots in the waveguides. In conventional rectangular serpentine waveguides, coupling between consecutive waveguides through the slots decreases the efficiency, uniformity, and controllability of the heating, drying, or curing of the material. Another problem is arcing at the corners of the slots, which pits the waveguide walls and causes unwanted reflections.

Thus, there is a need for a microwave applicator that can be used to heat, dry, or cure materials, such as fabrics, foams, or carpets, conveyed through the applicator.

SUMMARY

This need and others are satisfied by a microwave applicator embodying features of the invention. In one aspect, a microwave applicator comprises a serpentine waveguide coupled to a source of microwave energy. The waveguide comprises an array of waveguide passes having a pair of opposite first sides lying in first parallel planes and a pair of opposite second sides lying in second parallel planes perpendicular to the first planes. The four intersecting lines bound an interior with a rectangular cross section. The opposite first sides include slots. The waveguide passes are disposed side by side with the slots aligned to admit a material to be exposed to microwave energy into the waveguide passes. Waveguide bends connect the waveguide passes in series so that microwave energy flows in opposite directions in consecutive waveguide passes. Tunnels disposed between facing first sides of consecutive waveguide passes enclose the material to be exposed as it advances through the facing slots. The waveguides passes include conductive ridges projecting into the interior of the intersecting planes at the four corners of the rectangular cross section. The ridges reduce the microwave energy at the slots in the waveguide passes.

In another aspect, a microwave applicator comprises a serpentine waveguide having an applicator portion between first and second ends of the waveguide. The applicator portion comprises a number of waveguide passes disposed side by side. Aligned slots on opposite sides of the waveguide passes permit a material to advance through. A microwave energy source coupled to the first end of the serpentine waveguide supplies microwave energy flowing through the serpentine waveguide to the second end to heat the material advancing through the applicator portion. The cross section of the interior of the waveguide passes in a plane perpendicular to the flow of microwave energy is generally cruciform.

In yet another aspect, a microwave applicator comprises a serpentine waveguide having first and second ends. An applicator portion between the two ends comprises several waveguide passes disposed side by side. Slots on opposite first sides of the waveguide passes are aligned. The outermost slots in the outermost waveguide passes form entrance and exit slots for materials to be exposed in the applicator. A microwave energy source coupled to the first end of the serpentine waveguide supplies microwave energy flowing through the waveguide to its second end. Waveguide bends connect the waveguide passes in series so that microwave energy flows in opposite directions in consecutive waveguide passes. A conveyor extends through the aligned slots to transport a material into the applicator portion through the entrance and exit slots. Tunnels disposed between facing first sides of consecutive waveguide passes enclose the material being transported between the wave guide passes. Chokes around the entrance and exit slots decrease the leakage of microwave energy through the slots. The waveguide passes have an interior cross section that is generally rectangular with ridges projecting into the interior at the four corners of the otherwise rectangular interior cross section.

BRIEF DESCRIPTION OF THE DRAWINGS

These aspects and features of the invention, as well as its advantages, are better understood by reference to the following description, appended claims, and accompanying drawings, in which:

DETAILED DESCRIPTION

Figure 1:
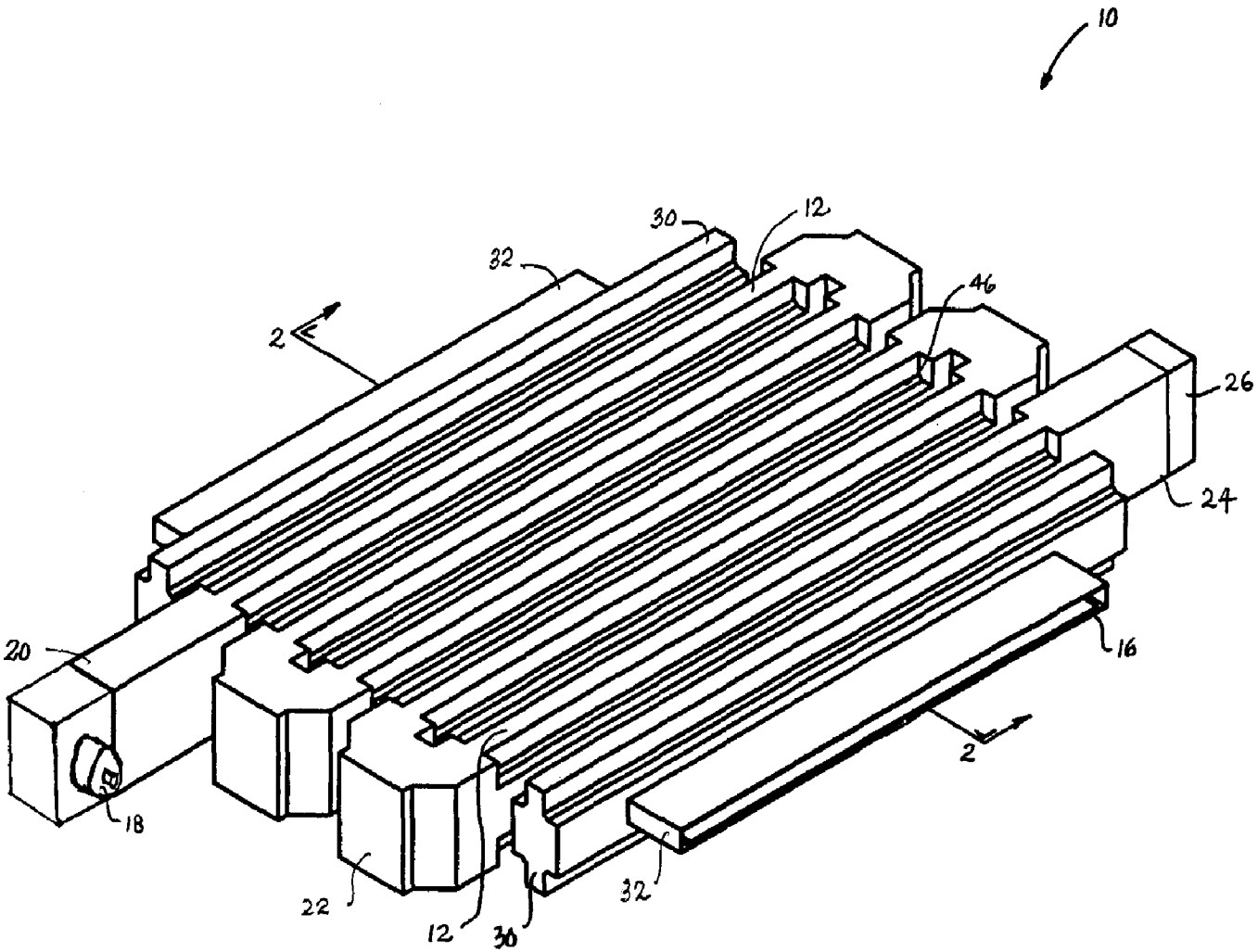
FIG. 1 is an isometric view of a serpentine waveguide applicator embodying features of the invention.
Figure 2:
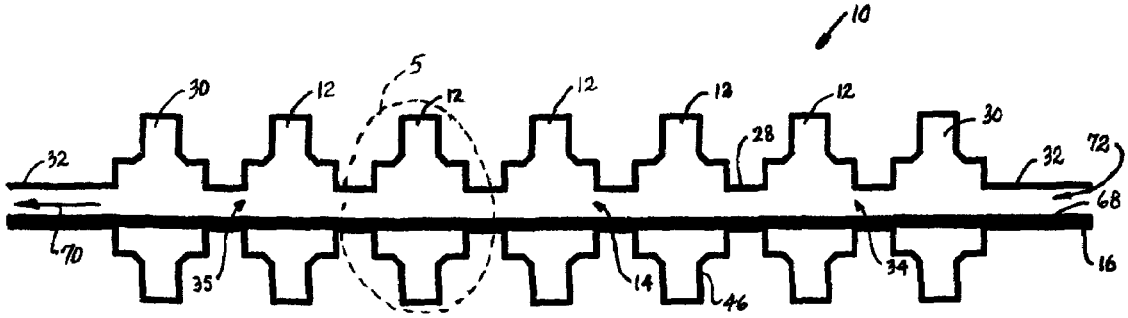
FIG. 2 is a cross sectional view of the waveguide applicator taken along lines 2-2 of FIG. 1.

A serpentine waveguide applicator embodying features of the invention is shown in FIGS. 1 and 2. The applicator 10 shown is composed of an array of five waveguide passes 12 arranged side by side, but other numbers of waveguide passes could be used. Slots 14 running the majority of the length of each waveguide pass are aligned and form a passage for material to enter and exit the applicator by means of a conveyor 16, for example. The conveyor is preferably a belt or chain conveyor made of a material relatively transparent to microwave radiation. The applicator is energized by a source of microwave energy 18, such as a magnetron operated at standard industrial microwave frequencies, e.g., 915 MHz or 2450 MHz. The magnetron injects microwave energy into a first end 20 of the serpentine applicator. Waveguide bends 22 connect consecutive waveguide passes in series so that microwave energy flows from the microwave source at the first end in opposite directions through consecutive waveguide passes toward a second end 24 of the applicator. The serpentine applicator preferably terminates at the second end in a matched impedance 26, such as a dummy water load, to provide traveling-wave operation. Alternatively, the serpentine applicator could terminate at the second end in a short circuit for standing-wave operation.

The aligned slots 14 of facing waveguide passes are enclosed on four sides by tunnels 28 between consecutive waveguide passes. For a microwave frequency of 915 MHz, the passes are separated by about 5 cm (2 in). Chokes, such as resonant chokes 30 and end chokes 32, are positioned at the entrance and exit slots 34, 35 (outermost slots in the outermost waveguide passes) to prevent leakage from the applicator. The resonant chokes shown in this example are identical in construction to the waveguide passes, except that each is terminated in short circuits at opposite ends.

Figure 5:
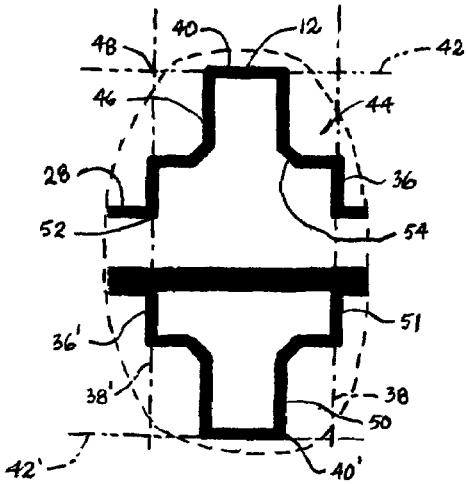
FIG. 5 is an enlarged view of the cross section of one of the waveguide passes of FIG. 2.

As shown in the cross sections of FIGS. 2 and 5, the waveguide passes 12 are formed by ridged rectangular waveguide. The slotted sides 36, 36' of the waveguide passes lie in parallel first planes 38, 38'. Top and bottom sides 40, 40' lie in parallel second planes 42, 42' that are perpendicular to the first planes. The intersecting planes define a rectangular interior cross section 44 in a plane (the plane of the drawing sheet of FIGS. 2 and 5) that is perpendicular to the first and second planes and to the flow of microwave energy. Conductive waveguide ridges 46 project into the interior at each of the four corners 48 of the rectangle. The ridges are formed by generally L-shaped walls. The longer branch 50 of the L-shaped ridge wall connects to the top or bottom side of the waveguide pass; the shorter side 51 connects to the corresponding slotted wall.

As shown in FIGS. 1, 2, and 5, the waveguide passes are formed by sheet metal. The hollow interior cross section of the waveguide passes is cruciform with one arm of the cross extending between the top and bottom sides and the other arm extending between the slotted sides. The conductive ridges projecting into the otherwise rectangular interior of the waveguide passes focus the microwave energy in the central region of the waveguide away from the slots. This reduces the magnitude of the electric field at the slots, whose sharp corners 52 produce high field gradients that would be favorable to arcing if the magnitude of the field were not reduced. But, because the ridged projections decrease the field at the slots, the tunnels 28 can meet the slotted sides of the waveguide at right angles. To further minimize the incidence of arcing, the ridges of the waveguide are truncated by chamfering or beveling to form a flat peak 54 and a lower field gradient. By reducing the magnitude of the electric field at the slots, the ridged waveguide structure also decreases the leakage of microwave energy through the slots into adjacent waveguide passes. In other words, reducing the electric field at the slots effectively increases the isolation between adjacent waveguide passes and reduces the crosstalk through the slots. In this way, microwaves in the slotted serpentine waveguide behave more like waves in a long, continuous waveguide.

Figure 3:
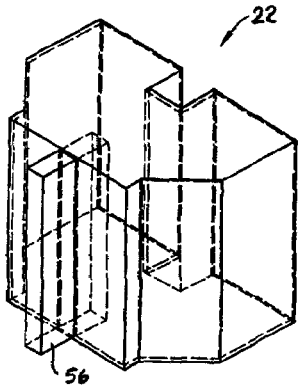
FIG. 3 is an isometric view of a waveguide bend usable in the waveguide applicator of FIG. 1.
Figure 4:
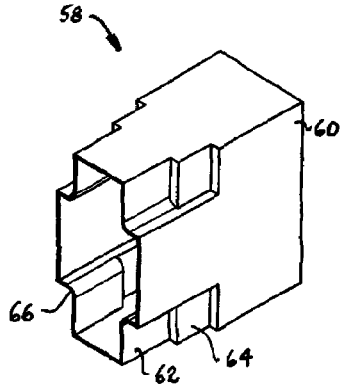
FIG. 4 is an isometric view of a stepped transformer used to transition between the ridged waveguide and the waveguide bend of the applicator of FIG. 1.

The waveguide bends 22 are shown in more detail in FIG. 3. Each bend changes the direction of the flow of microwave energy by 180° from one waveguide pass to the next consecutive pass. The bends have a generally rectangular cross section and may include an optional tuning bar 56 that may be inserted to different depths into the bend to minimize reflections. The rectangular waveguide bends are connected to the ridged waveguide passes at each end through stepped transformers 58. The stepped transformer shown in FIG. 4 includes three steps. The first step 60, which connects to an end of the waveguide bend, has a rectangular cross section matching that of the bend. The third step 62 has a cruciform cross section matching that of the waveguide passes, to which it is connected. An intermediate second step 64 has a cross section geometrically between the cross sections of the first and third steps to provide a transition from one cross section to the other. This allows the bends to be generally rectangular and easier to build. As also shown in FIG. 4, the peak 66 of the ridge projection is rounded rather than truncated. This merely illustrates another way that the field gradient can be reduced at the ridge in the waveguide passes as well. Of course, if the waveguide has truncated peaks, the matching transformer will, too. And, if the waveguide has rounded peaks, so will the transformer.

The resulting serpentine waveguide applicator is operated conventionally. As shown in FIG. 2, the conveyor 16 transports a material 68, such as a foam, a carpet, or a fabric to be heated, dried, or cured in a conveying direction 70 through the passage 72 formed by the aligned slots in the waveguide passes. Microwave energy flowing transverse to the conveying direction in the applicator heats the material as it advances through the applicator.

Although the invention has been described in detail with reference to a few preferred versions, other versions are possible. For example, the waveguide passes could be made from a standard rectangular waveguide with conductive solid bars, hollow inserts, or L-brackets mounted in the four corners to form the ridges instead of the particular sheet-metal construction shown in detail. As another example, the transformers could include more than three steps providing a transition between the waveguide passes and the bends. So, as these few examples suggest, the scope of the claims is not meant to be limited to the exemplary versions described in detail.

The invention claimed is:

1. A microwave applicator comprising:

a source of microwave energy;

a serpentine waveguide coupled to the source of microwave energy and having:

an array of waveguide passes having a pair of opposite first sides lying in first parallel planes and pair of opposite second sides lying in second parallel planes perpendicular to the first parallel planes bounding an interior having a rectangular cross section with four corners, wherein the opposite first sides include slots and the array of waveguide passes are disposed side by side with the slots aligned to admit a material to be exposed to microwave energy into the waveguide passes;

waveguide bends connecting the waveguide passes in series so that microwave energy flows in opposite directions in consecutive waveguide passes;

tunnels disposed between facing first sides of consecutive waveguide passes to enclose the material to be exposed as the material advances through the facing slots in the first sides of the consecutive waveguide passes;

wherein the waveguide passes include conductive ridges projecting into the interior of the first and second planes at the four corners of the rectangular cross section to reduce the microwave energy at the slots in the waveguide passes.

2. A microwave applicator as in claim 1 wherein each of the conductive ridges has a flat peak.

3. A microwave applicator as in claim 1 wherein each of the conductive ridges has a rounded peak.

4. A microwave applicator as in claim 1 wherein the second opposite sides do not meet the first opposite sides.

5. A microwave applicator as in claim 1 wherein each of the conductive ridges is L-shaped in cross section with one branch of the L attached to one of the first sides and the other branch of the L attached to one of the second sides.

6. A microwave applicator as in claim 1 wherein the cross section of the interior of the waveguide bends is rectangular and differs from the cross section of the waveguide passes and wherein the serpentine waveguide further includes stepped transformers between the waveguide bends and the waveguide passes having an interior cross section that includes a first end portion, rectangular in cross section, at a first end nearer the waveguide bend, a second end portion that matches the cross section of the waveguide passes at an opposite second end nearer the waveguide pass, and an intermediate portion having a cross section different from the cross sections of the first and second end portions to transition from the waveguide bends to the microwave passes.

7. A microwave applicator comprising:

a serpentine waveguide having a first end and a second end and an applicator portion between the first and second ends comprising a plurality of waveguide passes disposed side by side and including aligned slots in opposite first sides of the waveguide passes to permit a material to advance through the waveguide passes;

a microwave energy source coupled to the first end of the serpentine waveguide to supply microwave energy flowing through the serpentine waveguide to the second end and heating the material advancing through the applicator portion;

wherein the cross section of the interior of the waveguide passes in a plane perpendicular to the flow of microwave energy is generally cruciform to reduce the microwave energy at the slots in the first sides of the waveguide passes.

8. A microwave applicator as in claim 7 wherein the first sides of the waveguide passes lie in first parallel planes and wherein the waveguide passes further include opposite second sides that lie in second parallel planes perpendicular to the first parallel planes and four generally L-shaped walls attached between one of the first sides and one of the second sides.

9. A microwave applicator as in claim 8 wherein the L-shaped walls have a rounded vertex.

10. A microwave applicator as in claim 8 wherein the L-shaped walls have a truncated vertex.

11. A microwave applicator as in claim 7 wherein the serpentine waveguide further includes waveguide bends having a rectangular interior cross section and stepped transformers at opposite ends of the waveguide to connect two consecutive waveguide passes, wherein the stepped transformer has an interior cross section that varies in steps from rectangular, matching the interior cross section of the waveguide bends to cruciform matching the interior cross section of the waveguide passes.

12. A microwave applicator comprising:

a serpentine waveguide having a first end and a second end and an applicator portion between the first and second ends comprising a plurality of waveguide passes disposed side by side and including aligned slots in opposite first sides of the waveguide passes, wherein the outermost slots in the outermost waveguide passes form entrance and exit slots;

a microwave energy source coupled to the first end of the serpentine waveguide to supply microwave energy flowing through the serpentine waveguide to the second end;

waveguide bends connecting the waveguide passes in series so that microwave energy flows in opposite directions in consecutive waveguide passes;

a conveyor extending through the aligned slots in the applicator portion to transport a material into the applicator portion through the entrance and exit slots for exposure to microwave energy;

tunnels disposed between facing first sides of consecutive waveguide passes to enclose the material transported by the conveyor between the waveguide passes;

chokes disposed around the entrance and exit slots to decrease the leakage of microwave energy;

wherein the waveguide passes have an interior cross section that is generally rectangular with ridges projecting into the interior at the four corners of the otherwise rectangular interior cross section.

13. A microwave applicator comprising:

a serpentine waveguide having a first end and a second end and an applicator portion between the first and second ends comprising a plurality of waveguide passes having opposite top and bottom sides connected to a pair of opposite slotted sides having slots disposed between the top and bottom sides to form a generally rectangular interior cross section, wherein the waveguide passes are disposed side by side with the slots aligned;

a microwave energy source coupled to the first end of the serpentine waveguide to supply microwave energy flowing through the serpentine waveguide to the second end;

waveguide bends connecting the waveguide passes in series so that microwave energy flows in opposite directions in consecutive waveguide passes;

a conveyor extending through the aligned slots in the applicator portion to transport a material into the applicator portion for exposure to microwave energy;

tunnels disposed between facing slotted sides of consecutive waveguide passes to enclose the material transported by the conveyor between the waveguide passes;

wherein the waveguide passes have conductive ridges projecting interiorly from corners of the waveguide passes formed at the connections of the slotted sides to the top or bottom sides of the generally rectangular interior cross sections to reduce the microwave energy at the slots in the slotted sides of the waveguide passes.

* * * * *